US008744306B2

(12) United States Patent
Im et al.

(10) Patent No.: US 8,744,306 B2
(45) Date of Patent: Jun. 3, 2014

(54) DEVELOPMENT DEVICE ATTACHMENT UNIT AND IMAGE FORMING APPARATUS HAVING THE SAME

(75) Inventors: Dae Hyeok Im, Suwon-si (KR); Byung Sun Ahn, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 290 days.

(21) Appl. No.: 13/210,534

(22) Filed: Aug. 16, 2011

(65) Prior Publication Data

US 2012/0070191 A1 Mar. 22, 2012

(30) Foreign Application Priority Data

Sep. 16, 2010 (KR) ..... 10-2010-0091276

(51) Int. Cl.
*G03G 15/00* (2006.01)

(52) U.S. Cl.
USPC ..... 399/110; 399/258; 399/391

(58) Field of Classification Search
USPC ..... 399/110, 258, 391
See application file for complete search history.

(56) References Cited

U.S. PATENT DOCUMENTS

| | | | | |
|---|---|---|---|---|
| 8,401,423 | B2 * | 3/2013 | Suzuki | 399/111 |
| 2005/0019059 | A1 * | 1/2005 | Yokomori et al. | 399/111 |
| 2011/0311269 | A1 * | 12/2011 | Murooka | 399/110 |

* cited by examiner

*Primary Examiner* — Walter L Lindsay, Jr.
*Assistant Examiner* — Roy Y Yi
(74) *Attorney, Agent, or Firm* — Stanzione & Kim, LLP

(57) ABSTRACT

An image forming apparatus includes a guide member to guide movement of a developing device receiving member, which receives a plurality of developing devices, between the exterior and the interior of an image forming apparatus body. The guide member supports the developing device receiving member to enable rotation of the developing device receiving member within the body.

36 Claims, 14 Drawing Sheets

DEVELOPMENT DEVICE ATTACHMENT UNIT AND IMAGE FORMING APPARATUS HAVING THE SAME

CROSS-REFERENCE TO RELATED APPLICATIONS

This application claims the benefit of priority under 35 U.S.C. §119 to Korean Patent Application No. 2010-0091276, filed on Sep. 16, 2010 in the Korean Intellectual Property Office, the disclosure of which is incorporated herein by reference in its entirety.

BACKGROUND OF THE INVENTION

1. Field of the Invention

Embodiments of the present general inventive concept relate to an image forming apparatus having an improved configuration for attachment/detachment of a developing device.

2. Description of the Related Art

Color image forming methods of color image forming apparatuses may be classified into a transfer drum method, an intermediate transfer method, an image-on-image method, and a tandem method.

In a transfer drum method, a transfer sheet is wound on a surface of a transfer drum, which is made of a dielectric film and is arranged to face a photoconductor, and an electro-photographic process including formation of an electrostatic latent image, developing, and transfer is repeated for each of yellow, magenta, cyan, and black, to cause different colors of toner images to overlap in sequence on the transfer sheet, whereby a full color image is obtained.

In an intermediate transfer method, different colors of toner images are sequentially transferred onto a drum or a belt, which is referred to as an intermediate transfer medium, rather than the transfer sheet used in the transfer drum method, to form a full color image, and then, the full color image is retransferred onto a transfer sheet.

In an image-on-image method, an electro-photographic process including formation of an electrostatic latent image, developing, and transfer is repeatedly performed on a photoconductor for each of yellow, magenta, cyan, and black, and the resulting full color image formed on the photoconductor is transferred to a transfer sheet.

In a tandem method, images formed by image forming units arranged in parallel are sequentially transferred to overlap one another on a single transfer sheet, so as to form a full color image on the transfer sheet carried by a transfer belt.

In particular, a tandem type color image forming apparatus may have numerous types of available transfer sheets and also, may rapidly form a high-quality full color image.

SUMMARY OF THE INVENTION

Therefore, it is one aspect of the present general inventive concept to provide an image forming apparatus having an improved configuration for attachment/detachment of a developing device, to assure easy replacement, installation, or separation of the developing device.

It is another aspect of the present general inventive concept to provide an image forming apparatus having an improved configuration to allow a photoconductor of a developing device to be spaced apart from a transfer belt upon attachment/detachment of the developing device.

Additional aspects of the general inventive concept will be set forth in part in the description which follows and, in part, will be obvious from the description, or may be learned by practice of the general inventive concept.

Features of the present general inventive concept may be realized by an image forming apparatus that includes a body, a plurality of developing devices provided in the body, a developing device receiving member in which the plurality of developing devices is received, and a guide member to guide movement of the developing device receiving member between the exterior and the interior of the body. The guide member may support the developing device receiving member to enable rotation of the developing device receiving member within the body.

The guide member may support the developing device receiving member to stop the rotation of the developing device receiving member at the exterior of the body.

The developing device receiving member may include a first guide protrusion and a second guide protrusion, the guide member may include a first guide and a second guide, which have a groove shape, and the first guide protrusion may be separated from the first guide and the second guide protrusion may be supported by the second guide when the developing device receiving member is located entirely within the body.

The developing device receiving member may include a first guide protrusion and a second guide protrusion, the guide member may include a first guide and a second guide, which have a groove shape, and the first guide protrusion and the second guide protrusion may be supported respectively by the first guide and the second guide when at least a part of the developing device receiving member is located at the exterior of the body.

The first guide protrusion and the second guide protrusion may be arranged above and below each other, and the first guide and the second guide may be arranged above and below each other.

A rear end of the second guide may extend farther toward a rear side of the body than a rear end of the first guide.

The developing device receiving member may be rotatable about the second guide protrusion serving as a rotating shaft.

The guide member may support the developing device receiving member such that the developing device receiving member is disposed obliquely upward from a front side to a rear side of the body in a developing position.

The developing device receiving member may include a first guide protrusion and a second guide protrusion, the guide member may include a first guide, a second guide, and a stopper, and the first guide protrusion may be supported by the stopper while being separated from the first guide and the second guide protrusion is supported by the second guide when the developing device receiving member is located entirely within the body.

The stopper obliquely may extend downward from an end of the first guide.

The plurality of developing devices may be disposed obliquely upward from a front side to a rear side of the body.

The image forming apparatus may further include a door provided at a front surface of the body to open and close an opening through which the developing device receiving member passes.

The image forming apparatus may further include a transfer belt provided to face the plurality of developing devices, and the plurality of developing devices may be moved away from the transfer belt as the developing device receiving member is rotated upward of the body.

The plurality of developing devices may be moved closer to the transfer belt as the developing device receiving member is rotated downward of the body.

The image forming apparatus may further include a light scanning unit to form an electrostatic latent image on the plurality of developing devices.

The image forming apparatus may further include a door integrally formed with the light scanning unit to open and close an opening formed in a front surface of the body.

Features of the present general inventive concept may also be realized by an image forming apparatus that includes a body, a plurality of developing devices disposed obliquely upward from a front side to a rear side of the body, a transfer belt disposed to face the plurality of developing devices to extend obliquely upward from the front side to the rear side of the body, a developing device receiving member to support the plurality of developing devices, the developing device receiving member being moved toward the front side or the rear side of the body, and a guide member to guide movement of the developing device receiving member toward the front side or the rear side of the body and to support the developing device receiving member to enable rotation of the developing device receiving member that has moved toward the rear side of the body.

The guide member may support the developing device receiving member to stop rotation of the developing device receiving member that has moved toward the front side of the body.

The plurality of developing devices may be moved toward or away from the transfer belt as the developing device receiving member is rotated clockwise or counterclockwise.

Features of the present general inventive concept may also be realized by an image forming apparatus that includes a body, a developing unit provided in the body, and a developing device attachment/detachment unit to support the developing unit and move the developing unit between the exterior and the interior of the body, wherein the developing device attachment/detachment unit enables rotation of the developing unit located within the body.

The developing device attachment/detachment unit may stop the rotation of the developing unit located at the exterior of the body.

The image forming apparatus may further include a transfer unit disposed to face the developing unit, and the developing unit and the transfer unit may be disposed obliquely upward from the front side to the rear side of the body.

Features of the present general inventive concept may also be realized by a developing device receiving member including a main body having a receptacle to receive a plurality of developing devices and at least a first guide protrusion and a second guide protrusion located on a lateral side of the main body at a rear end of the main body, the first guide protrusion being located above the second guide protrusion with respect to a bottom surface of the main body.

The receptacle may receive the plurality of developing devices side-by-side in a front-to-rear direction.

Features of the present general inventive concept may also be realized by an image forming apparatus including a body having an opening at a first end and having a second end opposite the first end, at least a first guide located on opposing support structures within the body, and a developing device receiving member to receive at least one developing device, to move along the first guide from a developing device loading position to a developing position at which the at least one developing device forms an image on a developing medium, the developing device receiving member rotatable within the body and positioned at an oblique angle within the body in the developing position.

The first guide may be located on internal lateral side surfaces of the body.

The developing device receiving member may be rotatable between the oblique angle of the developing position and a substantially horizontal angle of the loading position.

The image forming apparatus may include at least a second guide located beneath the first guide.

The developing device receiving member may include first and second ends corresponding to the first and second ends of the body, and the developing device receiving member may include at least first and second guide protrusions at lateral sides of the second end of the developing device receiving member to be guided by the first and second guides, respectively.

The at least first guide protrusion may be an axis about which the developing device receiving member rotates to move between a substantially horizontal extracting angle to be extracted from the body and the oblique angle of the developing position.

The second guide may be an enclosed loop, and the second guide protrusion may be positioned inside the enclosed loop.

The image forming apparatus may further include a stopper located at the second end of the first guide, the stopper connected to the first guide and inclined at an angle with respect to the first guide to be inclined away from the first guide in a front-to-rear direction.

The image forming apparatus may further include at least a second guide located beneath the first guide, the second end of the second guide extending past an end of the stopper.

The developing device receiving member may rest against each of the stopper and the second guide when in the developing position.

The developing device receiving member may include first and second ends corresponding to the first and second ends of the body, and the developing device receiving member may include at least first and second guide protrusions at lateral sides of the second end of the developing device receiving member to be guided by the first and second guides, respectively, such that the first guide protrusion rests against the stopper and the second guide protrusion rests against an end of the second guide when the developing device receiving member is in the developing position.

BRIEF DESCRIPTION OF THE DRAWINGS

These and/or other aspects or features of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
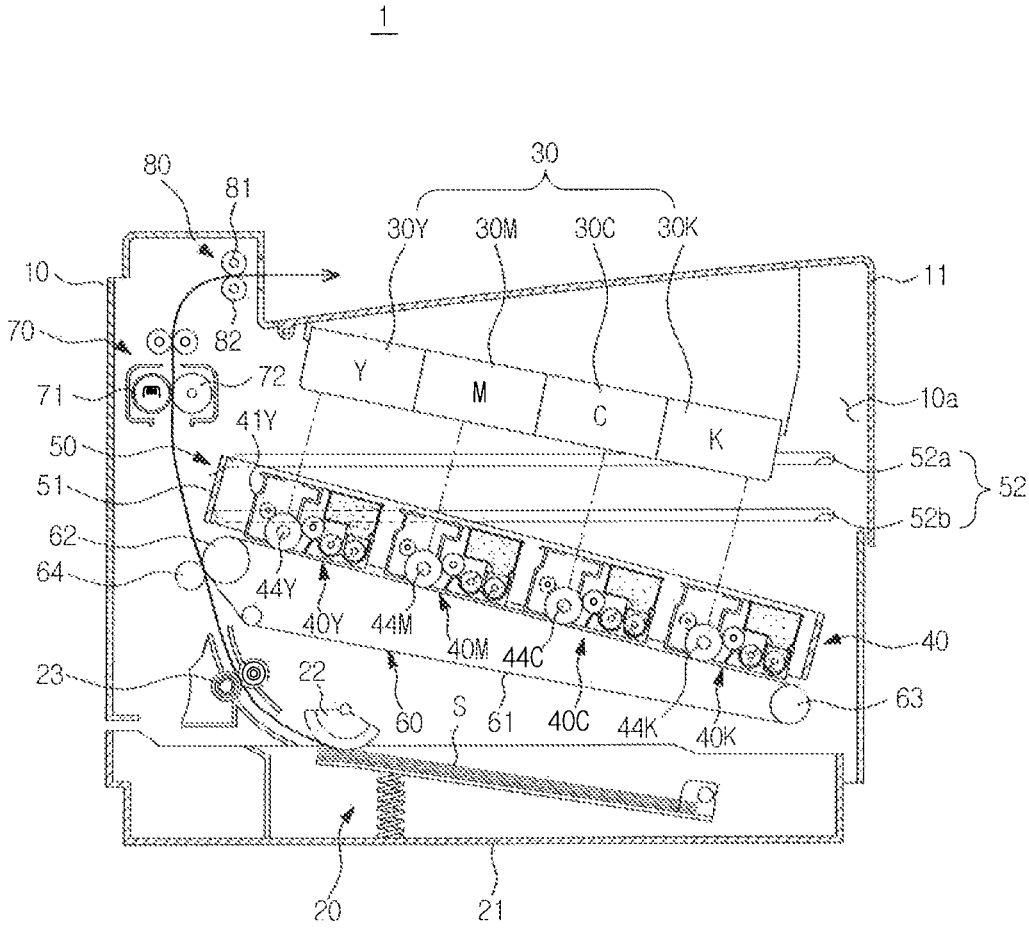
FIG. 1 is a view illustrating a configuration of an image forming apparatus in a closed state of a door according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures.

Figure 2:
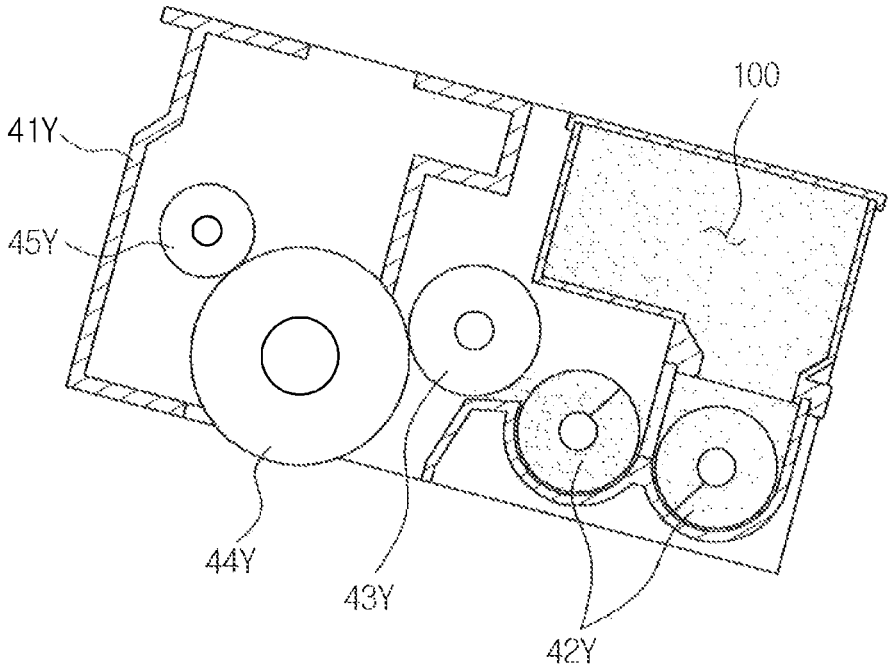
FIG. 2 is an enlarged view of a developing device in which yellow developer is received.
Figure 3:
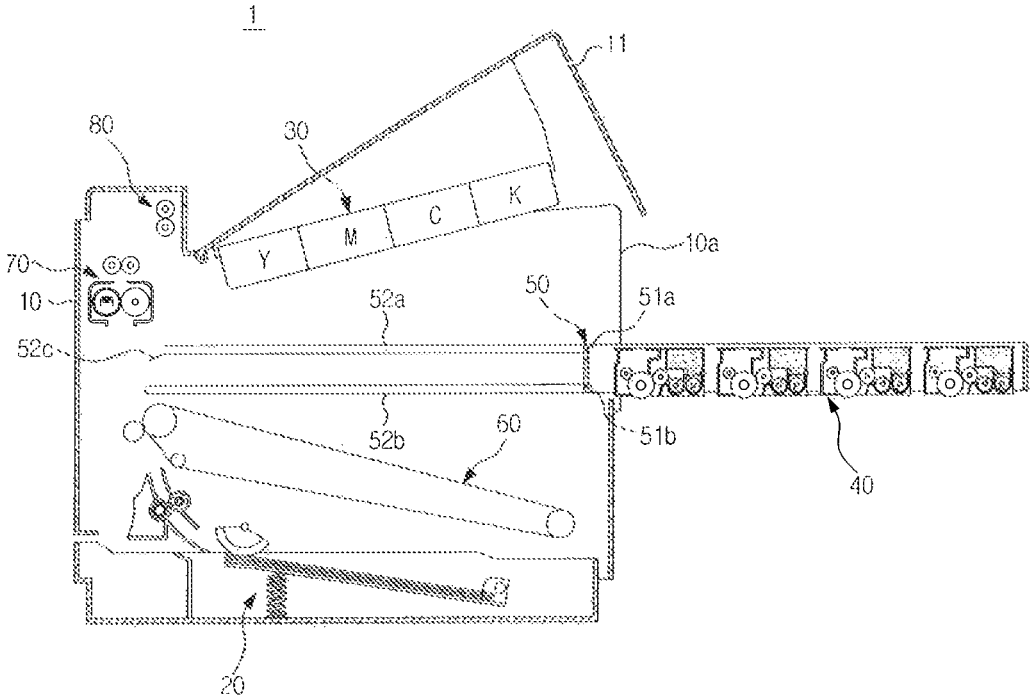
FIG. 3 is a view illustrating a configuration of the image forming apparatus in an open state of the door.
Figure 4:
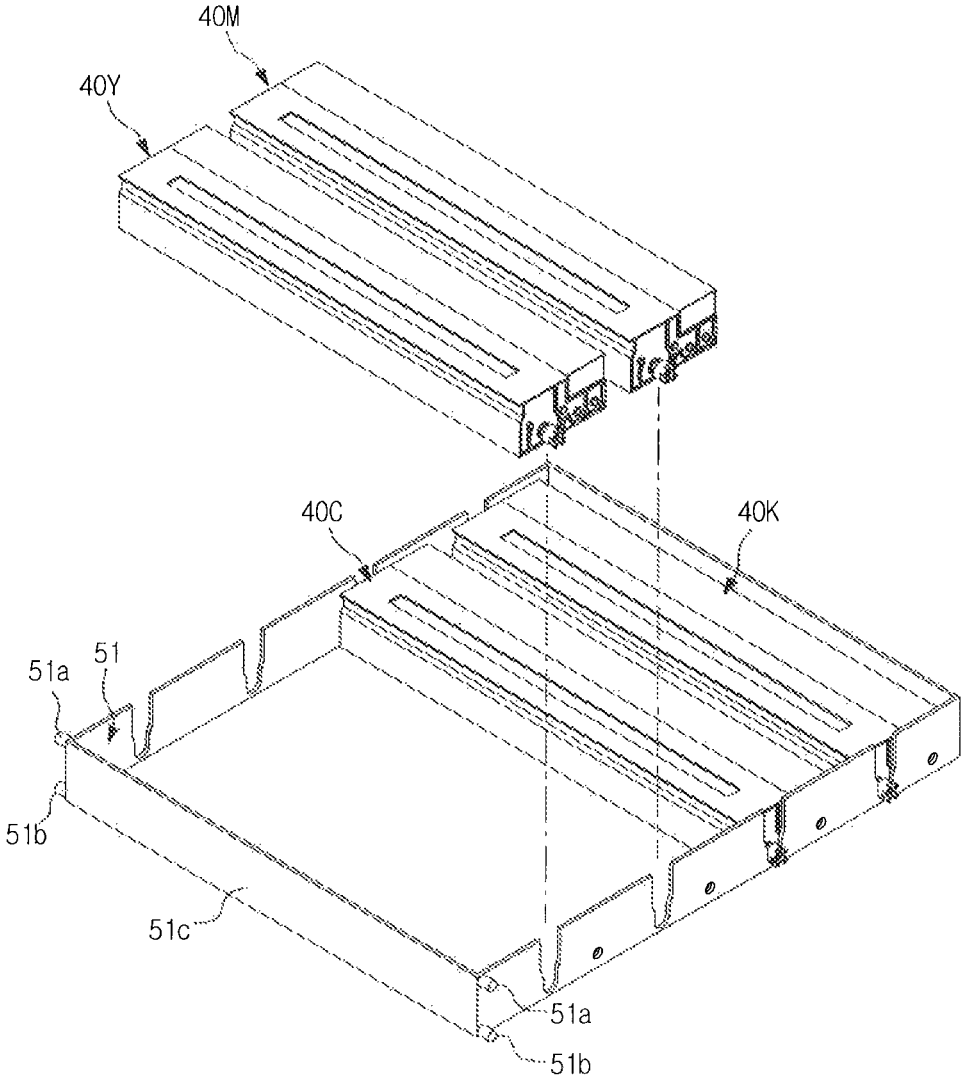
FIG. 4 is a perspective view illustrating a developing device receiving member of a developing device attachment/detachment unit.
Figure 5A:
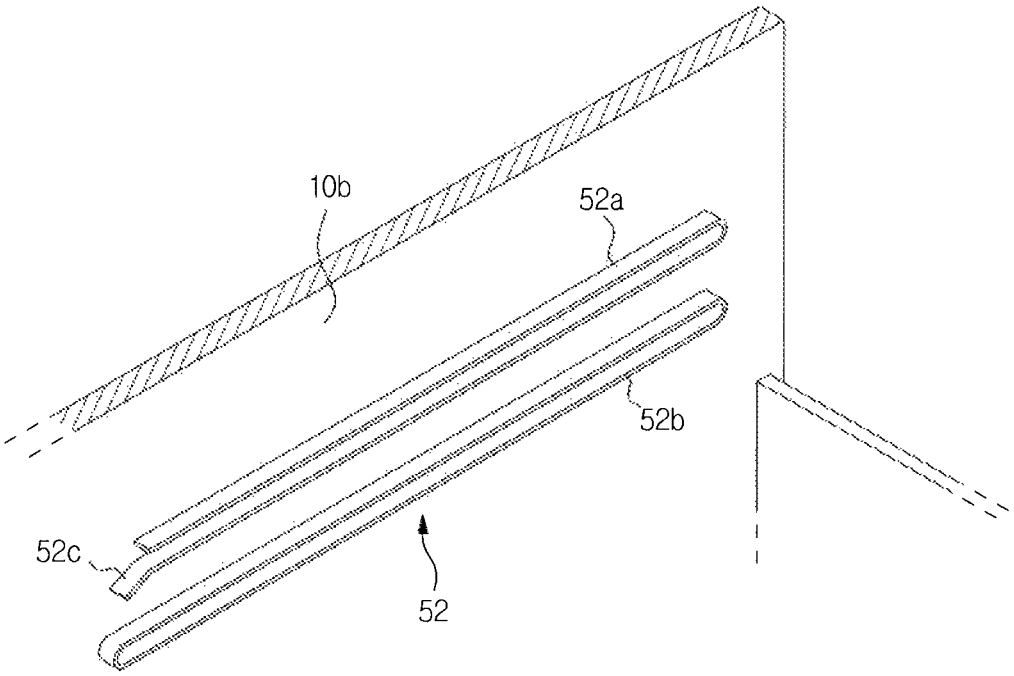
FIGS. 5A to 5C are perspective views illustrating a guide member of the developing device attachment/detachment unit.
Figure 5B:
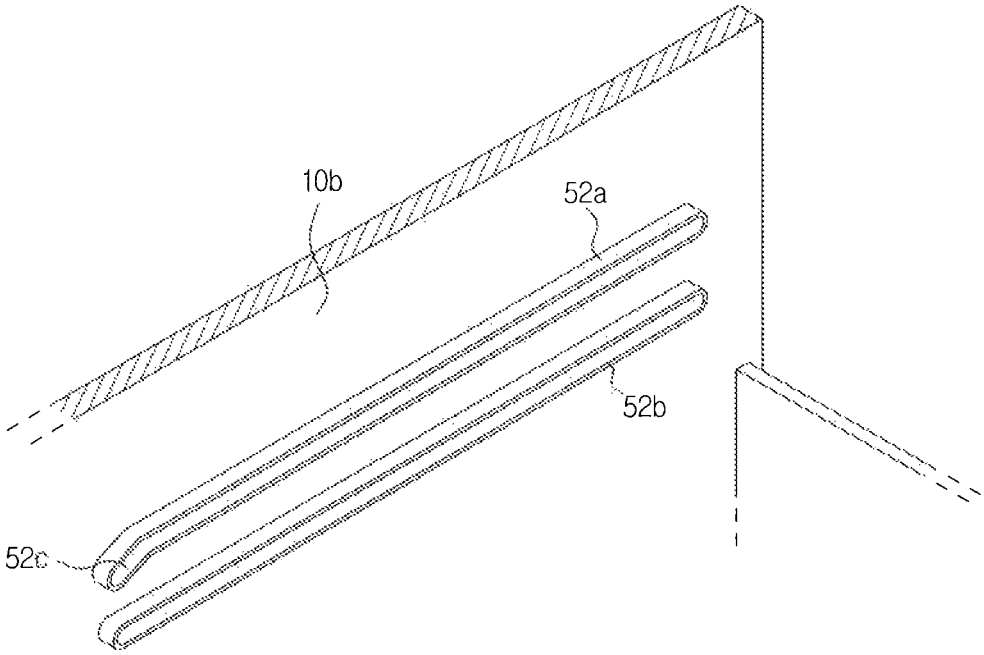
Figure 5C:
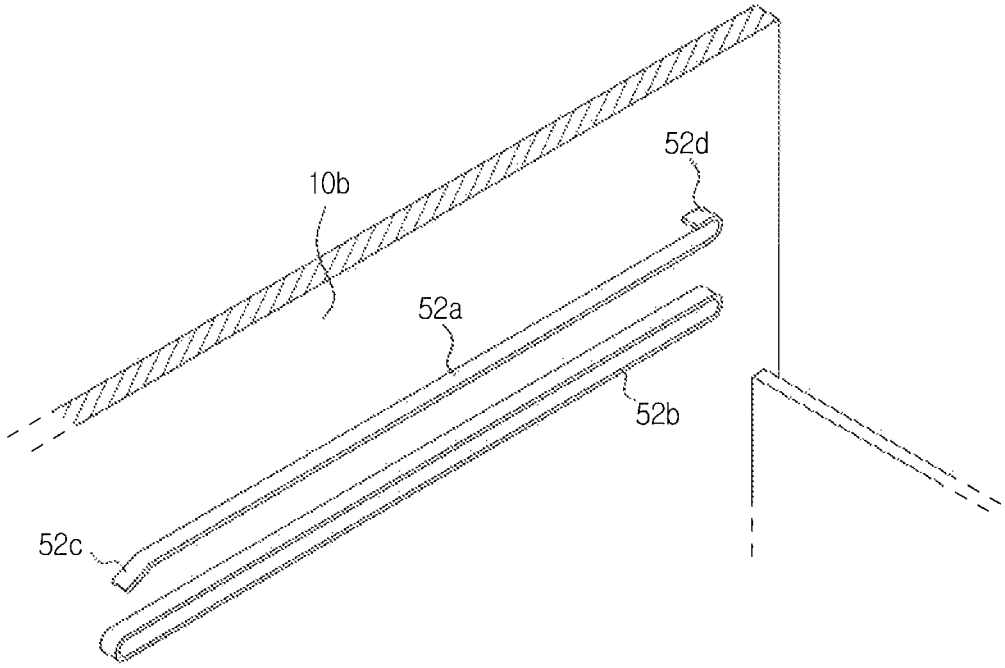

FIG. 1 is a view illustrating a configuration of an image forming apparatus in a closed state of a door, FIG. 2 is an enlarged view of a developing device in which yellow developer is received, FIG. 3 is a view illustrating a configuration of the image forming apparatus in an open state of the door, FIG. 4 is a perspective view illustrating a developing device receiving member of a developing device attachment/detachment unit, and FIGS. 5A to 5C are perspective views illustrating a guide member of the developing device attachment/detachment unit.

As illustrated in FIGS. 1 to 5C, the image forming apparatus 1 may include a body 10, a printing medium supply unit 20, a light scanning unit 30, a developing unit 40, a developing device attachment/detachment unit 50, a transfer unit 60, a fusing unit 70, and a printing medium discharge unit 80.

The body 10 defines an external appearance of the image forming apparatus 1 and may support a variety of elements therein. In the present specification and claims, for purposes of description, a bottom surface of the body 10 is the surface upon which the image forming apparatus 1 rests during normal operation, and may define a horizontal direction such that elements that are arranged at angles or obliquely are arranged at angles with respect to the horizontally-resting bottom surface.

A door 11 may be provided to open and close a front opening 10*a* of the body 10. The door 11 may occupy a part of an upper surface and a part of a front surface of the body 10 and may be rotatably installed with respect to the body. In other words, the front side of the body 10 is defined as the side having the door 11, and a rear side is the side opposite the front side. The rear side may be fixed or non-rotatable, and the door 11 may rotate with respect to the rear side. For example, the body 10 may include a hinge or other rotation member to allow the door to rotate 11.

The printing medium supply unit 20 may include a cassette 21 in which printing media S is stored, a pickup roller 22 to pick up the printing media S stored in the cassette 21 one by one, and a delivery roller 23 to deliver the printing medium toward the transfer unit 60.

The light scanning unit 30 may include four light scanning devices 30Y, 30M, 30C, and 30K, which serve to irradiate light corresponding to Yellow, Magenta, Cyan, and Black image information to photoconductors 44Y, 44M, 44C, and 44K of developing devices 40Y, 40M, 40C, and 40K, which will be described hereinafter, based on printing signals. The light, irradiated by the four light scanning devices 30Y, 30M, 30C and 30K, may form electrostatic latent images on the respective photoconductors 44Y, 44M, 44C, and 44K.

The light scanning unit 30 may be integrally formed with the door 11 or attached to the door 11. Thus, the light scanning unit 30 may be moved upward along with the door 11 when the door 11 is opened, and may be moved downward along with the door 11 and be returned to an original position thereof when the door 11 is closed. The light scanning unit 30 may be mounted to the door 11 to be arranged at an angle with respect to the bottom surface of the image forming apparatus 1. In addition, when the light scanning unit 30 is mounted to the door 11, the light scanning unit 30 may rotate to the same degree that the door 11 rotates when the door is opened and closed.

The developing unit 40 may be composed of four developing devices 40Y, 40M, 40C, and 40K, in which different colors of developers, for example, yellow, magenta, cyan, and black developers are stored, respectively. The four developing devices 40Y, 40M, 40C, and 40K may be disposed obliquely upward from the front side to the rear side of the body 10. For example, of the four developing devices 40Y, 40M, 40C, and 40K, a rearmost one, i.e. the developing device 40Y in which yellow developer is received may be located at the highest position, and a foremost one, i.e. the developing device 40K in which black developer is received may be located at the lowest position. The light scanning unit 30 may be mounted to the door 11 to rest at the same oblique angle as the developing unit 40 when the door 11 is closed and the developing unit 40 is in a developing position.

Hereinafter, the developing device 40Y in which yellow developer is received will be described by way of example. Of course, the following description may be equally applied to the other three developing devices 40M, 40C, and 40K in which magenta, cyan, and black developers are respectively received.

The developing device 40Y may include a housing 41Y, a developer receiving chamber 100, developer feed members 42Y, a developing member 43Y, and the photoconductor 44Y.

The developer receiving chamber 100 stores developer to be fed to the photoconductor 44Y. The developer feed members 42Y feed the developer stored in the developer receiving chamber 100 to the developing member 43Y. The developing member 43Y may form a visible image by attaching the developer to a surface of the photoconductor 44Y on which an electrostatic latent image has been formed by the light scanning device 30Y. The photoconductor 44Y is installed to be rotatable counterclockwise by a drive source (not shown), and may receive the developer fed from the developing member 43Y. Although the photoconductor 44Y of the present embodiment is integrally formed with the developing device 40Y, the photoconductor 44Y may be separately installed from the developing device 40Y in another embodiment.

A charging roller 45Y may be provided to charge the photoconductor 44Y with a predetermined potential before the light scanning device 30Y irradiates light to the photoconductor 44Y.

The developing device attachment/detachment unit 50 may include a developing device receiving member 51 and a guide member 52.

The developing device receiving member 51 receives the four developing devices 40Y, 40M, 40C, and 40K, and may be disposed obliquely upward from the front side to the rear side when in a developing position. The developing device receiving member 51 may also be arranged movably from an exterior position to an interior position of the body 10 under assistance of the guide member 52. When the developing device receiving member 51 is moved to the exterior position of the body 10, replacement of the respective four developing devices 40Y, 40M, 40C, and 40K may be possible. After completion of the replacement operation, the developing device receiving member 51 may be moved to the interior position of the body 10 to complete installation of the four developing devices 40Y, 40M, 40C, and 40K. Here, the exterior position (or a first position) of the body 10 is a position where at least a part of the developing device receiving member 51 is located at the exterior of the body 10, and the interior position (or a second position) of the body 10 is a position where the developing device receiving member 51 is located within the body 10. If the developing device receiving member 51 is located at the exterior position (or the first position) of the body 10, at least a part of the developing device receiving member 51 may penetrate through the opening 10*a* of the body 10 to be located within the body 10.

The developing device receiving member 51 may include a frame 51*c*, first guide protrusions 51*a*, and second guide protrusions 51*b*.

The frame 51*c* may be configured to support each of the four developing devices 40Y, 40M, 40C, and 40K. A handle (not shown) may be provided at a front surface of the frame 51*c* to allow a user to pull or push the frame 51*c* out of or into the body 10 by use of the handle.

The first guide protrusions 51*a* and the second guide protrusions 51*b* may be arranged above and below each other at the rear side of the frame 51*c*. In the present specification and claims, the rear side of the frame 51*c* is defined as the side adjacent to the rear side of the body 10, or the side opposite the front side of the frame 51*c* that is adjacent to the door 11 and that is removable from the front opening 10*a*. Also, the first guide protrusions 51*a* may be symmetrically arranged at opposite lateral sides of the frame 51*c* and also, the second guide protrusions 51*b* may be symmetrically arranged at opposite lateral sides of the frame 51*c*. In the present specification and claims, the lateral sides of the image forming apparatus 1 and frame 51*c* are defined as the sides located between the front and rear sides and between the top and bottom sides.

The guide member 52 may guide movement of the developing device receiving member 51 between the exterior position and interior position of the body 10. The guide member 52 may be part of the body 10 or may be formed on a support structure separate from the body 10. For example, the guide member 52 may be formed on an interior surface of the body 10 or upon support structures within the body 10 and separated from the lateral side surfaces of the body 10.

The guide member 52 may stop the rotation of the developing device receiving member 51 that has moved to the exterior position of the body 10. This may reduce the volume of the developing device receiving member 51 at the exterior of the body 10 and assure easy replacement of all of the developing devices 40Y, 40M, 40C, and 40K.

The guide member 52 may also allow rotation of the developing device receiving member 51 that has moved to the interior position of the body 10. This may prevent the photoconductors 44Y, 44M, 44C, and 44K of the plurality of developing devices 40Y, 40M, 400, and 40K from interfering with a transfer belt 61 during movement of the developing device receiving member 51 between the exterior position and the interior position of the body 10.

The guide member 52 may include first guides 52*a*, second guides 52*b*, and stoppers 52*c*.

As illustrated in FIG. 5A, the first guide 52*a* may protrude from a lateral side surface 10*b* of the body 10 to form a grooved path. The stopper 52*c* may obliquely extend downward from a rear end of the first guide 52*a*. The second guide 52*b* may protrude from the side surface of the body 10 to form a grooved path in the same manner as the first guide 52*a*, but a rear end of the second guide 52*b* may extend farther toward the rear side of the body 10 than the rear end of the first guide 52*a*. The first guide 52*a* and the second guide 52*b* may form a straight path approximately parallel to a plane on which the body 10 is placed. Also, the first guide 52*a* and the second guide 52*b* may be arranged above and below each other.

As illustrated in FIG. 5B, the second guide 52*b* may have a shape of a closed loop and the first guide 52*a* may also have a shape of a closed loop. Alternatively, as illustrated in FIG. 5C, the first guide 52*a* may have a shape of a ridge having the stopper 52*c* at the rear-most end and a second stopper 52*d* at a front-most end to stop the movement of the first guide protrusion 51*a* when the developing device receiving member 51 is extracted from the body 10.

The transfer unit 60 serves to transfer the visible image formed on the photoconductor 44Y to the printing medium, and may include the transfer belt 61, a driving roller 62, a driven roller 63, and a transfer roller 64.

The transfer belt 61 may be circulated in an endless loop by operation of the driving roller 62 and the driven roller 63. The transfer belt 61 may be arranged approximately parallel to the four developing devices 40Y, 40M, 40C, and 40K, and thus, may be disposed obliquely upward from the front side to the rear side of the body 10. Specifically, one end of the transfer belt 61 where the driving roller 62 is provided may be located at the highest position, and the other end of the transfer belt 61 where the driven roller 63 is provided may be located at the lowest position.

The transfer belt 61 faces the photoconductors 44Y, 44M, 440, and 44K such that visible images formed on the photoconductors 44Y, 44M, 440, and 44K are primarily transferred to the transfer belt 61.

The transfer roller 64 is disposed to face the driving roller 62 to define a nip region therebetween, and serves to secondarily transfer a visible image formed on the transfer belt 61 to the printing medium passing between the transfer roller 64 and the driving roller 62.

The fusing unit 70 includes a heating roller 71 having a heat source, and a press roller 72 installed to face the heating roller 71. When the printing medium passes between the heating roller 71 and the press roller 72, the transferred image is fixed to the printing medium by heat transferred from the heating roller 71 and pressure acting between the heating roller 71 and the press roller 72.

The printing medium discharge unit 80 includes a discharge roller 81 and a discharge backup roller 82, and serves to discharge the printing medium having passed through the fusing unit 70 out of the body 10.

Figure 6:
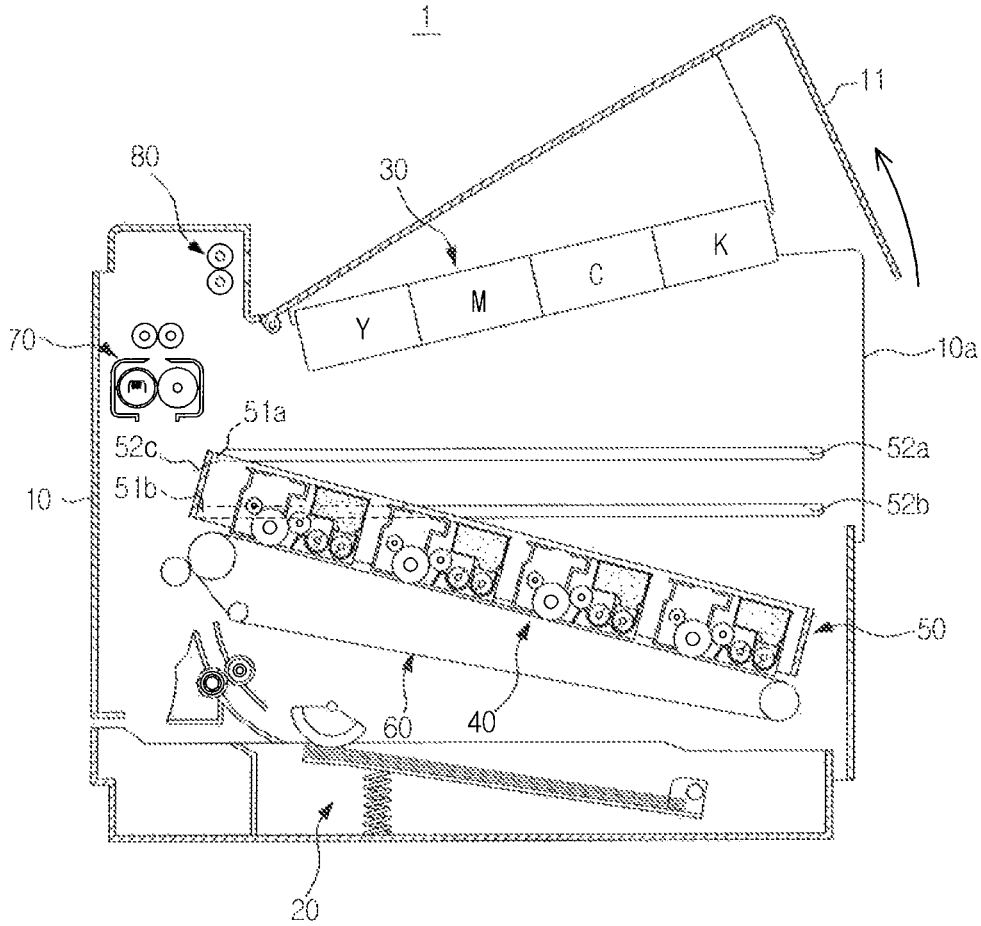
FIG. 6 is a sectional view illustrating an open state of the door of the image forming apparatus.
Figure 7:
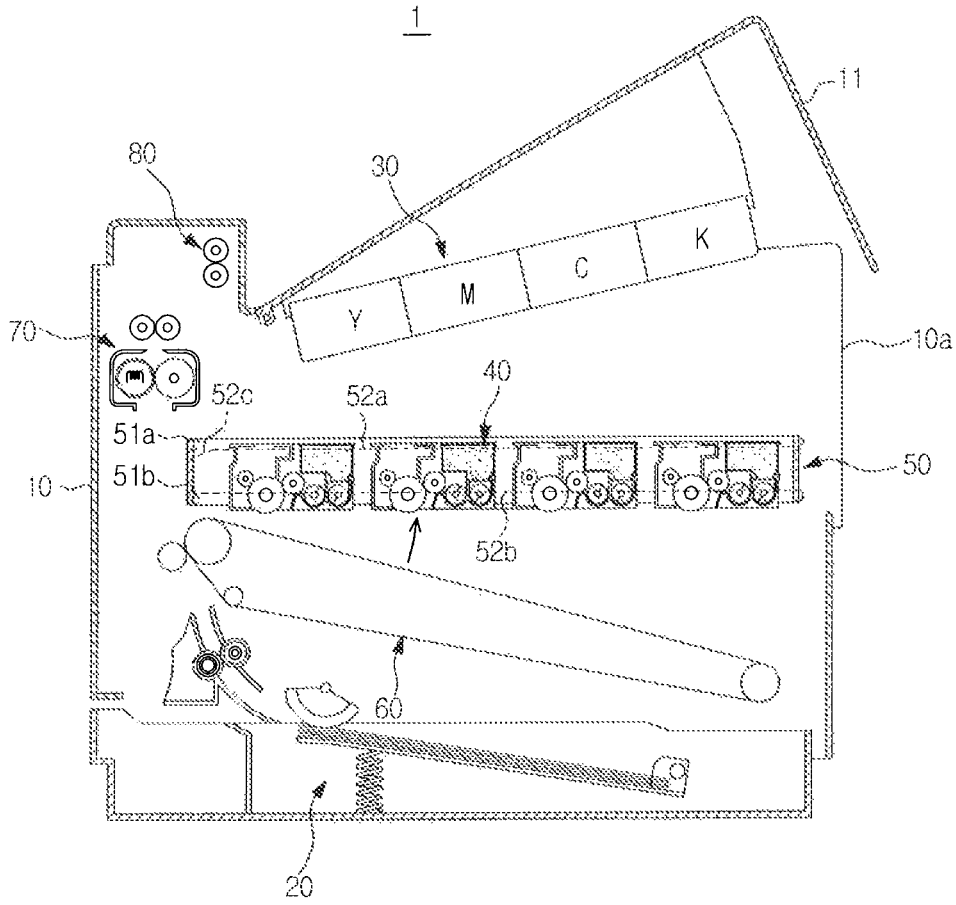
FIG. 7 is a sectional view illustrating rotation of the developing device receiving member.
Figure 8:
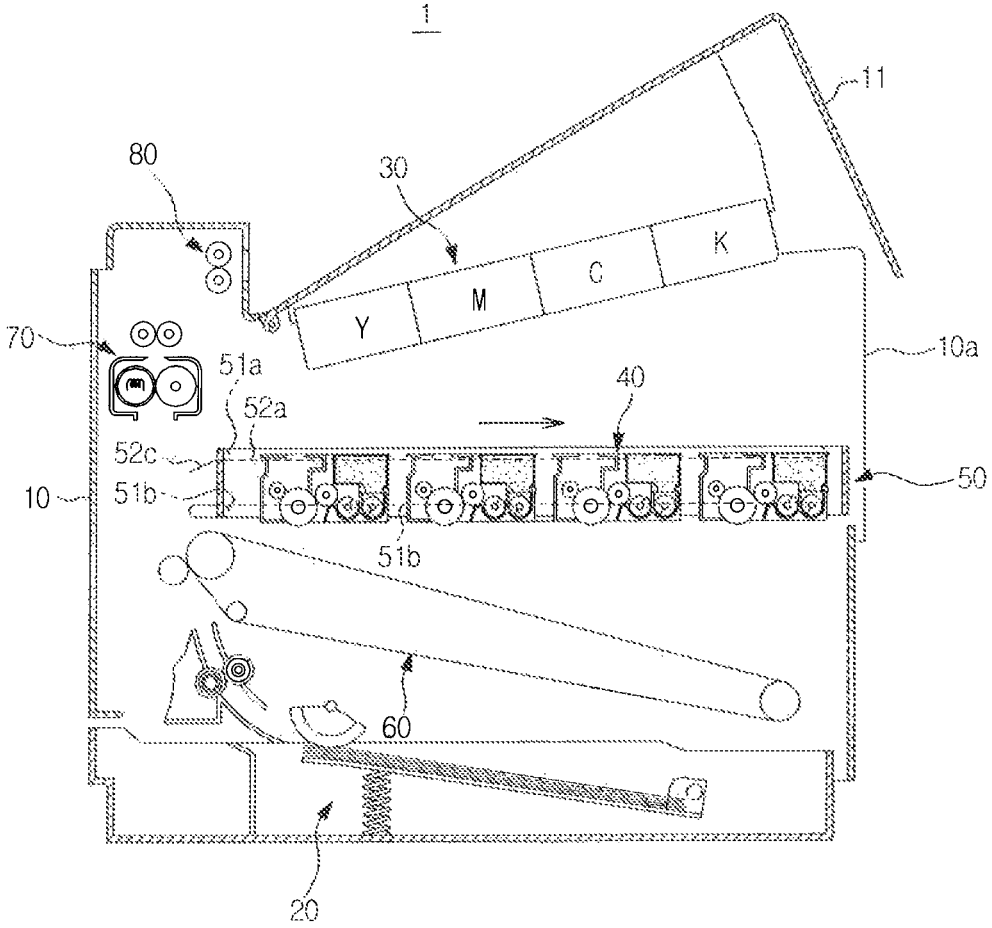
FIG. 8 is a sectional view illustrating movement of the developing device receiving member.

FIG. 6 is a sectional view illustrating an open state of the door of the image forming apparatus, FIG. 7 is a sectional view illustrating rotation of the developing device receiving member, and FIG. 8 is a sectional view illustrating movement of the developing device receiving member.

Hereinafter, attachment/detachment operations of the developing device of the image forming apparatus will be described in detail.

As illustrated in FIGS. 1 to 8, the image forming apparatus 1 may contain the four developing devices 40Y, 40M, 40C, and 40K and the developing device receiving member 51 to support the developing devices 40Y, 40M, 40C, and 40K, the developing device receiving member 51 being disposed obliquely upward from the rear side to the front side of the body 10. Since the light scanning unit 30 is disposed above the developing devices 40Y, 40M, 40C, and 40K, it may be necessary to move first the light scanning unit 30 upward, to allow the user to pull the developing device receiving member 51 out of the body 10.

As illustrated in FIG. 6, the user may first open the door 11. The light scanning unit 30 may be moved upward along with the door 11. In this case, the opening 10*a* of the body 10 may not be opened completely, or in other words, the door 11 may be prevented from rotating so as to allow the developing device receiving member 51 to be removed from the opening 10*a* but to prevent unnecessary access to or contact with the light scanning unit 30.

Thereafter, as illustrated in FIG. 7, the developing device receiving member 51 may be rotated counterclockwise about the second guide protrusion 51*b* that serves as a rotating shaft thereof. Specifically, the developing device receiving member 51 may be rotated such that a tip end thereof faces the opening 10*a* of the body 10. In this case, the first guide protrusion 51*a* is separated from the stopper 52*c*, thereby being ready to be inserted into the first guide 52*a*.

Thereafter, as illustrated in FIG. 8, if the user pulls the developing device receiving member 51, the first guide protrusion 51*a* may be inserted into and guided by the first guide 52*a*, and the second guide protrusion 51*b* may be guided by the second guide 52*b*. Then, the developing device receiving member 51, as illustrated in FIG. 3, may be moved to the exterior of the body 10, and the four developing devices 40Y, 40M, 40C, and 40K may also be moved to the exterior of the body 10. In this way, the user may replace the four developing devices 40Y, 40M, 400, and 40K respectively.

Thereafter, as illustrated in FIG. 8, the user may push the developing device receiving member 51 back into the body 10. In this case, the first guide protrusion 51*a* may be guided by the first guide 52*a* and the second guide protrusion 61*b* may be guided by the second guide 52*b*.

Thereafter, the user may completely push the developing device receiving member 51 into the body 10 to the position indicated in FIG. 7. In this case, the first guide protrusion 51*a* may be separated from the first guide 52*a* and the second guide protrusion 51*b* may be further guided inward by the second guide 52*b*. In other words, since the second guide 52*b* has a length greater than the first guide 52*a*, the first guide protrusion 51*a* may be moved past an end of the first guide 52*a* to be located above the stopper 52*c* while the second guide protrusion 61*b* is located at a rear end of the second guide 52*b*.

Thereafter, the user may rotate the developing device receiving member 51 clockwise about the second guide protrusion 51*b* that serves as a rotating shaft. Rotation of the developing device receiving member 51 may be stopped as the first guide protrusion 51*a* contacts and is supported by the stopper 52*c*. In this case, the four developing devices 40Y, 40M, 40C, and 40K and the developing device receiving member 51 to support the four developing devices 40Y, 40M, 40C, and 40K may be disposed obliquely upward from the front side to the rear side of the body 10, and the developing device receiving member 51 may be arranged to face the transfer belt 61.

Thereafter, as illustrated in FIG. 1, if the door 11 is closed, the light scanning unit 30 may be returned to an original position thereof. Thereby, the four developing devices 40Y, 40M, 40C, and 40K may be simultaneously installed in the body 10.

Figure 9A:
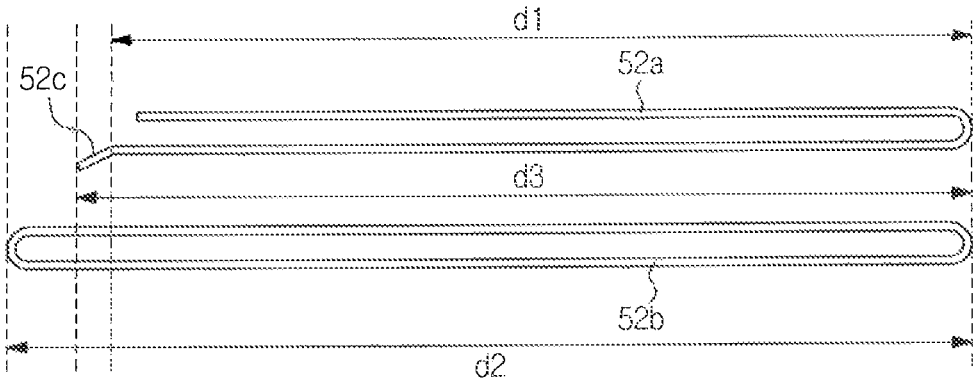
FIGS. 9A and 9B illustrate the first and second guides and guide protrusions according to embodiments of the present general inventive concept.
Figure 9B:
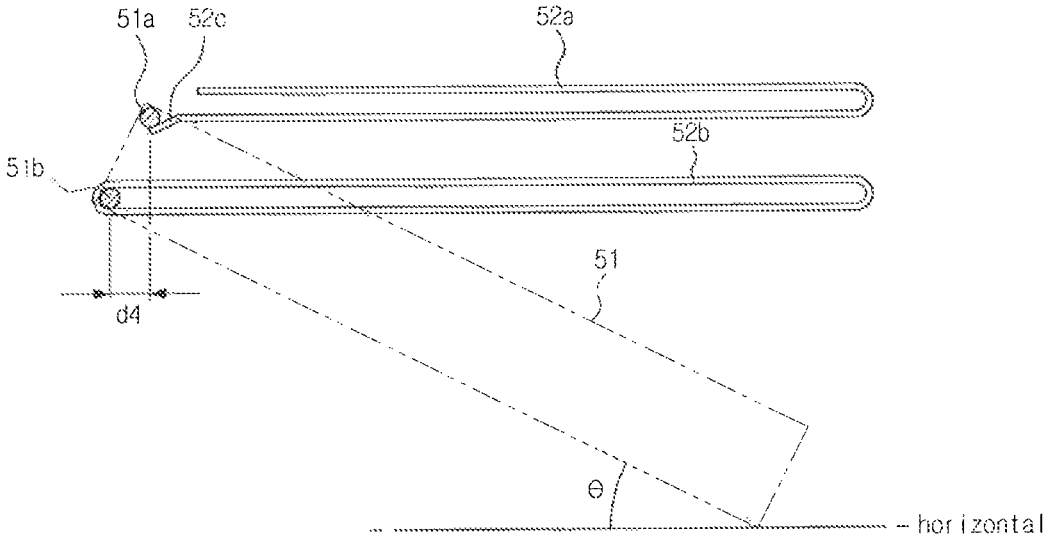

FIGS. 9A and 9B illustrate the relationship between the lengths of the first and second guides 52*a* and 52*b* and the angle of the developing device receiving member 51 in a developing position.

As illustrated in FIG. 9A, the first guide 52*a* comprises a substantially linear portion having a length d1 less than the length d2 of the second guide 52*b*. In addition, a stopper 52*c* located at the rear end of the first guide 52*a* extends past the end of the linear portion of the first guide 52*a* to have a length d3. The length d2 of the second guide 52*b* may be greater than the length d3 of the first guide 52*a* and the stopper 52*c*, and the difference between the lengths d2 and d3 may determine an angle of the developing device receiving member 51 when in the developing position.

As illustrated in FIG. 9B, the first guide protrusion 51*a* may rest against the stopper 52*c*, and the second guide protrusion 51*b* may abut the end of the second guide 52*b*. The first guide protrusion 51*a* and the second guide protrusion 51*b* may be separated in a linear direction by a distance d4. The greater the distance d4, the larger the angle θ of the developing device receiving member 51 when in the developing position. In other words, the distance d4 may be designed to cause the developing device receiving member 51 to rest in the developing position at an angle that corresponds to the angle of the transfer belt 61, illustrated in FIG. 1.

Figure 10A:
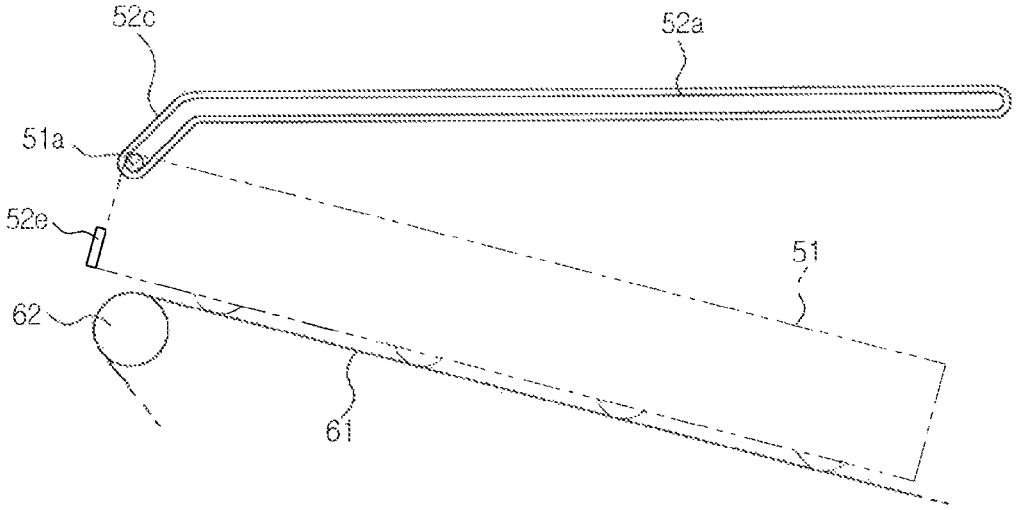
FIGS. 10A and 10B illustrate a guide of an image forming apparatus according to another embodiment of the present general inventive concept.

FIG. 10A illustrates a first guide 52*a* according to another embodiment of the present general inventive concept. As illustrated in FIG. 10, the second guide 52*b* may be omitted, and the developing device receiving member 51 may move into and out of the body 10 of the image forming apparatus 1 only along the first guide 52*a*. In such a case, a third stopper 52*e* may be provided to support the developing device receiving member 51 in the developing position, or the third stopper 52*e* may be omitted, and the developing devices 40Y, 40M, 40C, and 40K may rest upon the transfer belt 61.

Figure 10B:
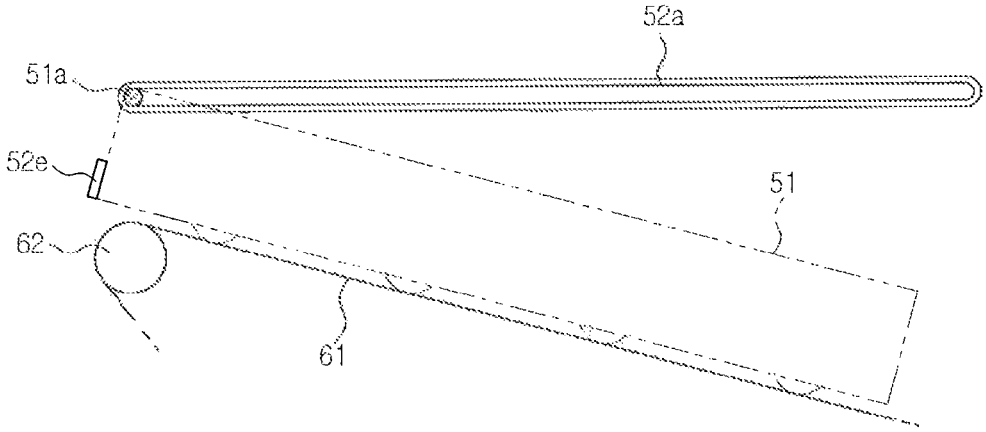

Although the stopper 52*c* of FIG. 10A may be useful to indicate a developing position of the developing device receiving member, FIG. 10B illustrates an embodiment in which the stopper 52*c* may be omitted. In such a case, the first guide protrusion 51*a* may reach an end of the first guide 52*a* and may be inclined at an angle in the developing position at the end of the first guide 52*a*.

As is apparent from the above description, an image forming apparatus according to an embodiment of the present general inventive concept may have a compact configuration to minimize an installation space thereof.

Further, it may be possible to minimize an operation radius of a developing device receiving member that is moved for separation/installation of a developing device, and to reduce the volume of the image forming apparatus.

Furthermore, it may be possible to prevent malfunction caused by interference between a transfer belt and a photoconductor of the developing device.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus, comprising:

a body;

a plurality of developing devices provided in the body;

a developing device receiving member in which the plurality of developing devices is received; and a guide member to guide movement of the developing device receiving member between the exterior and the interior of the body, wherein the guide member supports the developing device receiving member to enable linear movement of the developing device receiving member so as to mount the developing device receiving member within the body and rotation of the developing device receiving member so as to position the developing device receiving member at a developing position at which the plurality of developing devices form an image on a medium within the body.

2. The apparatus according to claim 1, wherein the guide member supports the developing device receiving member to prevent rotation of the developing device receiving member at the exterior of the body.

3. The apparatus according to claim 1, wherein:

the developing device receiving member includes a first guide protrusion and a second guide protrusion;

the guide member includes a first guide and a second guide, which have a groove shape; and the first guide protrusion is separated from the first guide and the second guide protrusion is supported by the second guide when the developing device receiving member is located within the body.

4. The apparatus according to claim 1, wherein:

the developing device receiving member includes a first guide protrusion and a second guide protrusion;

the guide member includes a first guide and a second guide, which have a groove shape; and the first guide protrusion and the second guide protrusion are supported respectively by the first guide and the second guide when at least a part of the developing device receiving member is located at the exterior of the body.

5. The apparatus according to claim 3 or 4, wherein the first guide protrusion and the second guide protrusion are arranged above and below each other, and the first guide and the second guide are arranged above and below each other.

6. The apparatus according to claim 3, wherein a rear end of the second guide extends farther toward a rear side of the body than a rear end of the first guide.

7. The apparatus according to claim 3, wherein the developing device receiving member is rotatable about the second guide protrusion serving as a rotating shaft.

8. The apparatus according to claim 1, wherein the guide member supports the developing device receiving member such that the developing device receiving member is disposed obliquely upward from a front side to a rear side of the body when in a developing position.

9. The apparatus according to claim 8, wherein:

the developing device receiving member includes a first guide protrusion and a second guide protrusion;

the guide member includes a first guide, a second guide, and a stopper; and the first guide protrusion is supported by the stopper while being separated from the first guide and the second guide protrusion is supported by the second guide when the developing device receiving member is located within the body.

10. The apparatus according to claim 9, wherein the stopper obliquely extends downward from an end of the first guide.

11. The apparatus according to claim 1, wherein the plurality of developing devices is disposed obliquely upward from a front side to a rear side of the body when in a developing position.

12. The apparatus according to claim 1, further comprising a door provided at a front surface of the body to open and close an opening through which the developing device receiving member passes.

13. The apparatus according to claim 1, further comprising a transfer belt provided to face the plurality of developing devices, wherein the plurality of developing devices is moved away from the transfer belt as the developing device receiving member is rotated upward.

14. The apparatus according to claim 13, wherein the plurality of developing devices is moved closer to the transfer belt as the developing device receiving member is rotated downward.

15. The apparatus according to claim 1, further comprising a light scanning unit to form an electrostatic latent image on the plurality of developing devices.

16. The apparatus according to claim 15, further comprising a door integrally formed with the light scanning unit to open and close an opening formed in a front surface of the body.

17. An image forming apparatus comprising:

a body;

a plurality of developing devices disposed obliquely upward from a front side to a rear side of the body when in a developing position;

a transfer belt disposed to face the plurality of developing devices to extend obliquely upward from the front side to the rear side of the body;

a developing device receiving member to support the plurality of developing devices, the developing device receiving member being movable toward the front side and the rear side of the body, respectively; and a guide member to guide movement of the developing device receiving member toward the front side and the rear side of the body, respectively, wherein the guide member supports the developing device receiving member to enable rotation of the developing device receiving member that has moved toward the rear side of the body.

18. The apparatus according to claim 17, wherein the guide member supports the developing device receiving member to prevent rotation of the developing device receiving member that has moved toward the front side of the body.

19. The apparatus according to claim 17, wherein the plurality of developing devices is moved toward and away from the transfer belt as the developing device receiving member is rotated clockwise and counterclockwise, respectively.

20. An image forming apparatus, comprising:

a body;

a developing unit provided in the body; and a developing device attachment/detachment unit to support the developing unit and move the developing unit between the exterior and the interior of the body, wherein the developing device attachment/detachment unit enables linear movement of the developing unit so as to mount the developing unit within the body and rotation of the developing unit so as to position the developing unit at a developing position at which the developing unit forms an image on a medium within the body.

21. The apparatus according to claim 20, wherein the developing device attachment/detachment unit prevents rotation of the developing unit located at the exterior of the body.

22. The apparatus according to claim 20, further comprising a transfer unit disposed to face the developing unit, wherein the developing unit and the transfer unit are disposed obliquely upward from the front side to the rear side of the body when the developing unit is in a developing position.

23. A developing device receiving member, comprising:

a main body having a receptacle to receive a plurality of developing devices; and at least a first guide protrusion and a second guide protrusion located on a lateral side of the main body at a rear end of the main body, the first guide protrusion being located above the second guide protrusion with respect to a bottom surface of the main body.

24. The developing device receiving member of claim 23, wherein the receptacle receives the plurality of developing devices side-by-side in a front-to-rear direction.

25. An image forming apparatus, comprising:

a body having an opening at a first end and having a second end opposite the first end;

at least a first guide located on opposing support structures within the body; and a developing device receiving member to receive at least one developing device, to move along the first guide from a developing device loading position to a developing position at which the at least one developing device forms an image on a developing medium, the developing device receiving member rotatable within the body and positioned at an oblique angle within the body in the developing position.

26. The image forming apparatus of claim 25, wherein the first guide is located on internal lateral side surfaces of the body.

27. The image forming apparatus of claim 25, wherein the developing device receiving member is rotatable between the oblique angle of the developing position and a substantially horizontal angle of the loading position.

28. The image forming apparatus of claim 25, further comprising at least a second guide located beneath the first guide.

29. The image forming apparatus of claim 28, wherein the developing device receiving member includes first and second ends corresponding to the first and second ends of the body, and the developing device receiving member includes at least first and second guide protrusions at lateral sides of the second end of the developing device receiving member to be guided by the first and second guides, respectively.

30. The image forming apparatus of claim 29, wherein the at least first guide protrusion is an axis about which the developing device receiving member rotates to move between a substantially horizontal extracting angle to be extracted from the body and the oblique angle of the developing position.

31. The image forming apparatus of claim 29, wherein the second guide is an enclosed loop, and the second guide protrusion is positioned inside the enclosed loop.

32. The image forming apparatus of claim 25, further comprising:

a stopper located at the second end of the first guide, the stopper connected to the first guide and inclined at an angle with respect to the first guide to be inclined away from the first guide in a front-to-rear direction.

33. The image forming apparatus of claim 32, further comprising at least a second guide located beneath the first guide, the second end of the second guide extending past an end of the stopper.

34. The image forming apparatus of claim 33, wherein the developing device receiving member rests against each of the stopper and the second guide when in the developing position.

35. The image forming apparatus of claim 34, wherein the developing device receiving member includes first and second ends corresponding to the first and second ends of the body, and the developing device receiving member includes at least first and second guide protrusions at lateral sides of the second end of the developing device receiving member to be guided by the first and second guides, respectively, such that the first guide protrusion rests against the stopper and the second guide protrusion rests against an end of the second guide when the developing device receiving member is in the developing position.

36. An image forming apparatus comprising:

a body; and a developing device receiving member disposed in the body to receive at least one developing device and to move from a developing device loading position to a developing position, the developing device receiving member being rotatable within the body such that the developing device receiving member is rotatable between an oblique angle of the developing position and a substantially horizontal angle of the developing device loading position.

* * * * *